US006044568A

United States Patent [19]

Raymond

[11] Patent Number: 6,044,568

[45] Date of Patent: Apr. 4, 2000

[54] CHALK LINE DISPENSER HOLDER SYSTEM

[76] Inventor: Jacques J. Raymond, 792 Back Mountain Rd., Goffstown, N.H. 03045

[21] Appl. No.: 09/022,367

[22] Filed: Feb. 12, 1998

[51] Int. Cl.[7] ..... E04F 21/00

[52] U.S. Cl. ..... 33/414; 33/1 G

[58] Field of Search ..... 33/413, 414, 756, 33/1 G

[56] References Cited

U.S. PATENT DOCUMENTS

| | | | |
|---|---|---|---|
| 1,251,712 | 1/1918 | Wakimoto | 33/414 |
| 3,078,581 | 2/1963 | Foster | 33/414 |
| 3,099,091 | 7/1963 | Hindall | 33/414 |
| 3,122,836 | 3/1964 | Aciego | 33/413 |
| 3,171,210 | 3/1965 | Kundel | 33/413 |
| 4,921,507 | 5/1990 | Beyer | 33/413 |
| 4,976,041 | 12/1990 | Oshiro et al. | 33/392 |

*Primary Examiner*—Andrew H. Hirshfeld
*Assistant Examiner*—R A Smith

[57] ABSTRACT

A chalk line dispenser holder system is provided including at least one chalk line dispenser for selectively dispensing a chalk line from a periphery of the dispenser. Also included is a structure connected to an end of the chalk line for resting on a recipient surface onto which chalk is to be applied. A weight of the structure precludes the movement of the end of the chalk line.

9 Claims, 3 Drawing Sheets

CHALK LINE DISPENSER HOLDER SYSTEM

BACKGROUND OF THE INVENTION

1. Field of the Invention

The present invention relates to chalk line dispensers and more particularly pertains to a new chalk line dispenser holder system for holding an end of a chalk line stationary during use and further storing and transporting at least one chalk line dispenser after use.

2. Description of the Prior Art

The use of chalk line dispensers is known in the prior art. More specifically, chalk line dispenser heretofore devised and utilized are known to consist basically of familiar, expected and obvious structural configurations, notwithstanding the myriad of designs encompassed by the crowded prior art which have been developed for the fulfillment of countless objectives and requirements.

Known prior art chalk line dispenser holder system include U.S. Pat. No. 5,212,875; U.S. Pat. No. 5,042,159; U.S. Pat. No. 5,063,681; U.S. Pat. No. 4,660,291; U.S. Pat. No. Des. 345,513; and U.S. Pat. 4,592,148.

In these respects, the chalk line holder according to the present invention substantially departs from the conventional concepts and designs of the prior art, and in so doing provides an apparatus primarily developed for the purpose of holding an end of a chalk line stationary during use and further storing and transporting at least one chalk line dispenser after use.

SUMMARY OF THE INVENTION

In view of the foregoing disadvantages inherent in the known types of chalk line dispensers now present in the prior art, the present invention provides a new chalk line holder construction wherein the same can be utilized for holding an end of a chalk line stationary during use and further storing and transporting at least one chalk line dispenser after use.

The general purpose of the present invention, which will be described subsequently in greater detail, is to provide a new chalk line holder apparatus and method which has many of the advantages of the chalk line dispensers mentioned heretofore and many novel features that result in a new chalk line holder which is not anticipated, rendered obvious, suggested, or even implied by any of the prior art chalk line dispensers, either alone or in any combination thereof.

To attain this, the present invention generally comprises a pair of chalk line dispensers each with a generally disk-shaped configuration. The chalk line dispensers each have a side face including a reel extending therefrom for selectively dispensing a chalk line from a periphery of the dispenser. FIGS. 1 & 2 show a base including a lower extent having a vertically oriented cylindrical configuration. A bottom face of the lower extent includes a circular recess formed in a central extent thereof. As shown in FIG. 4, a downwardly extending annular lip is defined. The lip has a pair of radially extending, diametrically disposed bores formed therein, as shown in FIG. 5. The base further includes an upper extent with a frusto-conical configuration. Also included is a tubular mounting post having a bottom end coupled to a top of the upper extent of the base and extending vertically therefrom. The post has a pair of C-shaped mounting brackets mounted thereon adjacent to a top end thereof and within a common horizontal plane. Each mounting bracket has a pair of ends each with an inwardly extending lip for defining a rectangular slot. Such slot functions for releasably receiving an associated one of the chalk line dispensers such that the reel thereof extends between the inwardly extending lips and the chalk line depends downwardly. Finally, a tubular handle is provided having a length equal to less than ¼ that of the post. As shown in FIGS. 1 & 2, the handle is integrally coupled at a central extent thereof to the top of the mounting post in perpendicular relationship therewith for gripping purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who arc not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chalk line holder apparatus and method which has many of the advantages of the chalk line dispensers mentioned heretofore and many novel features that result in a new chalk line holder which is not anticipated, rendered obvious, suggested, or even implied by any of the prior art chalk line dispensers, either alone or in any combination thereof.

It is another object of the present invention to provide a new chalk line holder which may be easily and efficiently manufactured and marketed.

It is a further object of the present invention to provide a new chalk line holder which is of a durable and reliable construction.

An even further object of the present invention is to provide a new chalk line holder which is susceptible of a low cost of manufacture with regard to both in materials and labor, and which accordingly is then susceptible of low prices of sale to the consuming public, thereby making such chalk line holder economically available to the buying public.

Still yet another object of the present invention is to provide a new chalk line holder which provides in the apparatuses and methods of the prior art some of the advantages thereof, while simultaneously overcoming some of the disadvantages normally associated therewith.

Still another object of the present invention is to provide a new chalk line holder for holding an end of a chalk line stationary during use and further storing and transporting at least one chalk line dispenser after use.

Even still another object of the present invention is to provide a new chalk line holder that includes at least one chalk line dispenser including a reel mounted thereon for selectively dispensing a chalk line from a periphery of the dispenser. Also included is a structure connected to an end of the chalk line for resting on a recipient surface onto which chalk is to be applied. A weight of the structure precludes the movement of the end of the chalk line.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
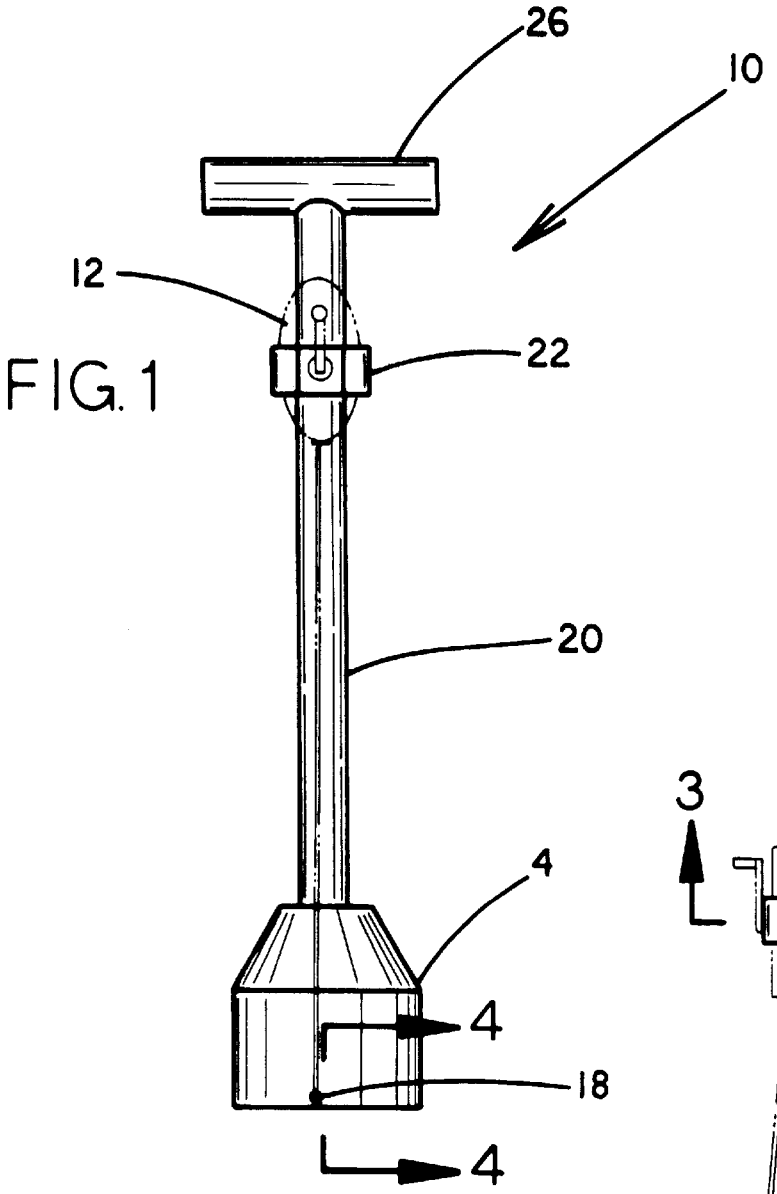
FIG. 1 is a side view of a new chalk line holder according to the present invention.

With reference now to the drawings, and in particular to FIGS. 1 through 5 thereof, a new chalk line holder embodying the principles and concepts of the present invention and generally designated by the reference numeral 10 will be described.

The present invention, designated as numeral 10, includes a pair of chalk line dispensers 12 each with a generally disk-shaped configuration. The chalk line dispensers each have a side face including a reel extending therefrom for selectively dispensing a chalk line from a periphery of the dispenser.

Figure 2:
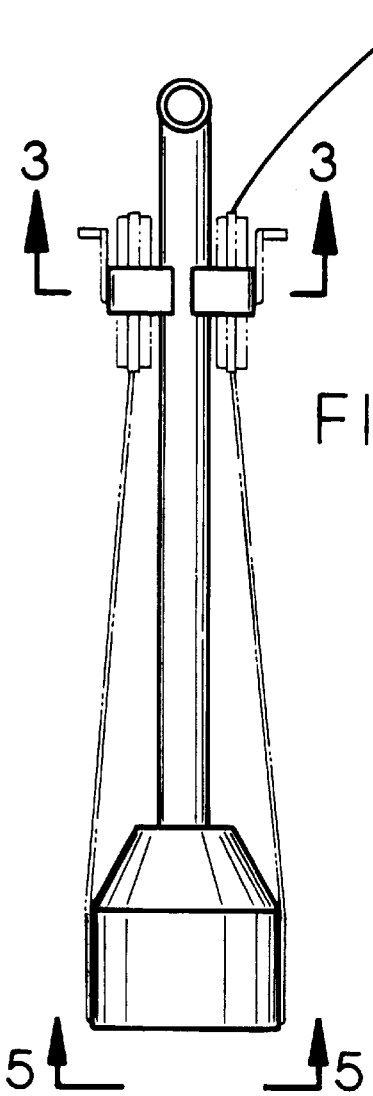
FIG. 2 is another side view of the present invention.
Figure 3:
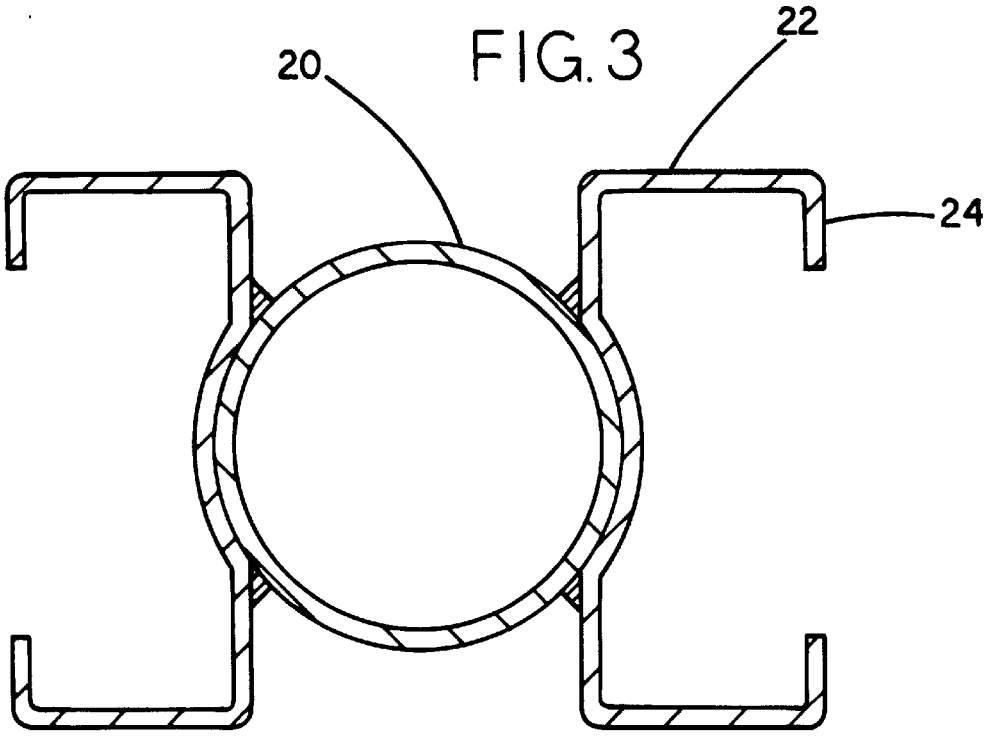
FIG. 3 is a cross-sectional view of the present invention taken along line 3—3 shown in FIG. 2.
Figure 4:
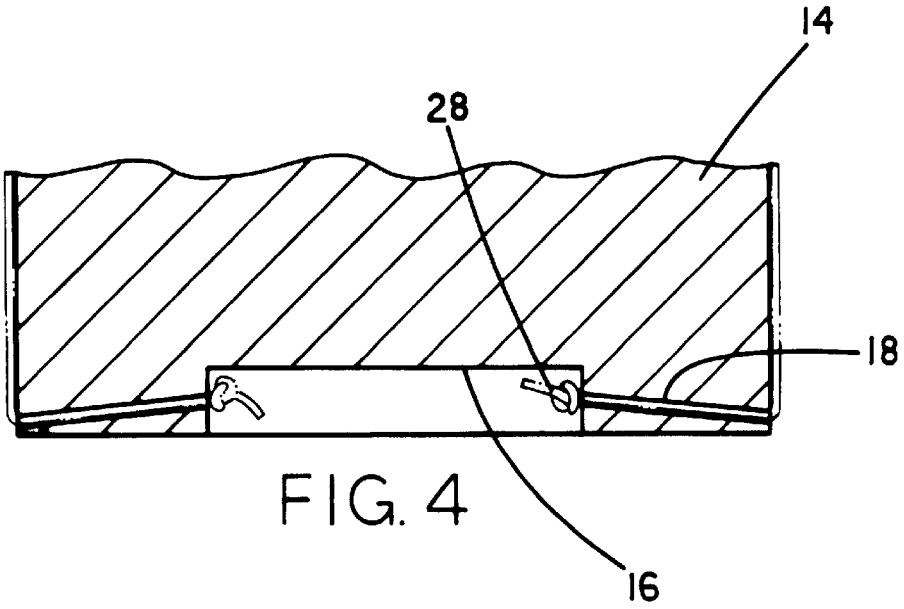
FIG. 4 is a side cross-sectional view of the present invention.
Figure 5:
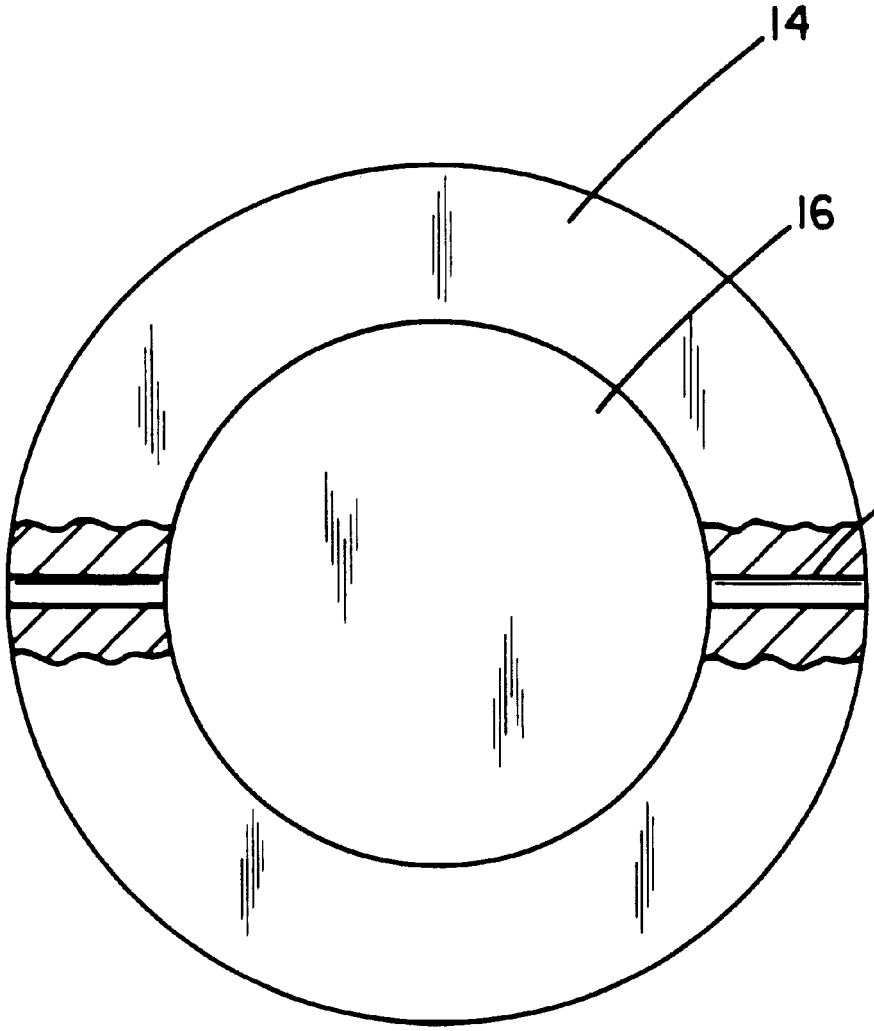
FIG. 5 is a bottom view of the present invention.

FIGS. 1 & 2 show a weighted base 14 including a lower extent having a vertically oriented cylindrical configuration. A bottom face of the lower extent includes a circular recess 16 formed in a central extent thereof. As shown in FIG. 4, a downwardly extending annular lip is thereby defined. The lip has a pair of radially extending, diametrically disposed bores 18 formed therein, as shown in FIG. 5. An outlet of each bore is preferably situated just next to the bottom face of the base. To preserve the strength of the bore, the bores are preferably angled downwardly as they extend radially from the recess. The base further includes an upper extent with a frusto-conical configuration.

Also included is a tubular mounting post 20 having a bottom end coupled to a top of the upper extent of the base and extending vertically therefrom. A length of the post is at least three times that of the base. The post has a pair of C-shaped mounting brackets 22 mounted thereon adjacent to a top end thereof and within a common horizontal plane. The mounting brackets are preferably mounted on diametrically opposed sides of the post. Each mounting bracket has a pair of ends each with an inwardly extending lip 24 for defining a rectangular slot. The brackets function for releasably receiving an associated one of the chalk line dispensers such that the reel thereof extends between the inwardly extending lips and the chalk line depends downwardly. To accomplish this, the length of the bracket is preferably less than a diameter of the dispensers.

Finally, a tubular handle 26 is provided having a length equal to less than ¼ that of the post. As shown in FIGS. 1 & 2, the handle is integrally coupled at a central extent thereof to the top of the mounting post in perpendicular relationship therewith for gripping purposes.

As shown in FIG. 4, an end of each chalk line is situated through an associated one of the bores and has a knot 28 formed therein for precluding the removal thereof. During use, the base may be rested on a recipient surface on to which the chalk is to be applied. Next, at least one of the chalk line dispensers is removed from the associated bracket for use. After, use the chalk lines may be retracted and the dispensers may be stored in the brackets.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chalk line dispenser holder system comprising, in combination:

a pair of chalk line dispensers each with a generally disk-shaped configuration and having a side face including a reel extending therefrom for selectively dispensing a chalk line from a periphery of the dispenser;

a base including a lower extent having a vertically oriented cylindrical configuration with a bottom face including a circular recess formed in a central extent thereof thereby defining a downwardly extending annular lip, the lip having a pair of radially extending, diametrically disposed bores formed therein, the base further including an upper extent with a frusto-conical configuration;

a tubular mounting post including a bottom end coupled to a top of the upper extent of the base and extending vertically therefrom, the post having a pair of C-shaped mounting brackets mounted thereon adjacent to a top end thereof and within a common horizontal plane, each mounting bracket having a pair of ends each with an inwardly extending lip for defining a rectangular slot for releasably receiving an associated one of the chalk line dispensers such that the reel thereof extends between the inwardly extending lips and the chalk line depends downwardly; and a tubular handle having a length equal to less than ¼ that of the post, the handle integrally coupled at a central extent thereof to the top of the mounting post in perpendicular relationship therewith;

wherein an end of each chalk line is situated through an associated one of the bores and has a knot formed therein for precluding the removal thereof.

2. A chalk line dispenser holder system comprising, in combination:

at least one chalk line dispenser including a reel mounted therein for selectively dispensing a chalk line from a periphery of the dispenser; and a base connected to an end of the chalk line for resting on a recipient surface onto which chalk is to be applied, wherein a weight of the base precludes the movement of the end of the chalk line, the base having a lower extent having a cylindrical configuration with a bottom face including a circular recess formed in a central extent thereof thereby defining a downwardly extending annular lip, the lip having at least one radially extending bore formed through the lip, wherein the end of the chalk line is passed through the bore and secured in the circular recess, the base further including an upper extent with a frusto-conical configuration.

3. The chalk line dispenser holder system as set forth in claim 2 wherein the base has a handle.

4. The chalk line dispenser holder system as set forth in claim 3 wherein the handle has a T-shaped configuration.

5. The chalk line dispenser holder system as set forth in claim 2 wherein the dispenser is adapted to be removably mounted and supported by the base.

6. The chalk line dispenser holder system as set forth in claim 5 wherein the dispenser is adapted to be removably mounted and supported by the base via a bracket.

7. The chalk line dispenser holder system as set forth in claim 6 wherein the bracket resides above a point at which the chalk line of the dispenser is coupled to the base.

8. The chalk line dispenser holder system as set forth in claim 6 wherein the bracket is C-shaped.

9. The chalk line dispenser holder system as set forth in claim 2 wherein the base is adapted to support a pair of dispensers each having a chalk line coupled to the base.

* * * * *